US006383040B2

(12) United States Patent
Ito et al.

(10) Patent No.: US 6,383,040 B2
(45) Date of Patent: May 7, 2002

(54) JET PROPULSION SYSTEM FOR WATERCRAFT

(75) Inventors: Kazumasa Ito; Tetsuya Ishino; Chihiro Matsumoto, all of Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/682,031

(22) Filed: Jul. 12, 2001

Related U.S. Application Data

(63) Continuation-in-part of application No. 09/630,668, filed on Aug. 2, 2000.

(30) Foreign Application Priority Data

Aug. 4, 1999 (JP) ..... 11-221667
Jul. 12, 2000 (JP) ..... 2000-210831

(51) Int. Cl.[7] ..... B63H 11/00
(52) U.S. Cl. ..... 440/38; 440/47
(58) Field of Search ..... 440/38, 47, 88, 440/89

(56) References Cited

U.S. PATENT DOCUMENTS

| | | | |
|---|---|---|---|
| 3,249,083 | A | 5/1966 | Irgens |
| 5,140,926 | A | 8/1992 | Denston |
| 5,330,374 | A | 7/1994 | Ishino |
| 5,391,064 | A | 2/1995 | Lopez |
| 5,550,337 | A | 8/1996 | Tazaki et al. |

*Primary Examiner*—Stephen Avila
(74) *Attorney, Agent, or Firm*—Ernest A. Beutler

(57) ABSTRACT

A jet propelled watercraft having an improved extension assembly for dampening pulsations from the impeller of the jet propulsion unit and also for mounting the jet propulsion unit. The structure simplifies the overall assembly and permits individual tuning with conventional units.

7 Claims, 3 Drawing Sheets

JET PROPULSION SYSTEM FOR WATERCRAFT

CROSS REFERENCE TO RELATED APPLICATIONS

This application is a continuation in part of the application of the same title, U.S. Ser. No. 09/630,668, filed Aug. 2, 2000 and assigned to the assignee hereof.

BACKGROUND OF INVENTION

This invention relates to a jet propulsion system for a watercraft and more particularly to an improved device for minimizing the sounds and vibrations generated by the jet propulsion unit.

Jet propulsion units are quite popular in connection with the propulsion of watercraft and especially a particular type of watercraft referred to as a "personal watercraft". These types of watercraft generally are designed to be operated by a rider who may carry no more than one to three additional passengers. Frequently these passengers are seated in straddle, tandem fashion on a longitudinally extending seat that is formed at the rear of the watercraft with the propulsion unit being disposed beneath the seat.

One problem particular with this type of construction can be best understood by reference to the aforenoted copending application. As noted therein in conventional constructions the water inlet passage through the lower part of the watercraft hull curve upwardly from their inlet opening and directly registered with the impeller housing of the jet pump in close proximity to its impeller. It has been found that this causes pulsations in the water that is transmitted back through the forward wall of the bulkhead that separates the jet pump from the engine compartment and can create unpleasant vibrations in the watercraft and sounds that are undesirable.

It is, therefore, a first principal feature of this invention to provide an improved and low cost jet propulsion unit for a personal watercraft that avoids these pulsations.

It is a further object of this invention to provide an arrangement for utilizing this feature in conjunction with conventional type jet pumps so as to not require a redesign in either the hull or the jet pump in order to use the feature of the invention.

The copending application presents a solution to this problem, but further improvements are desirable. It is therefore another object of this invention to provide such further improvements.

SUMMARY OF INVENTION

This invention is adapted to be embodied in a personal watercraft that is comprised of a hull having an undersurface including a vertically extending bulkhead defining in part a rear portion of an engine compartment containing a prime mover. The hull undersurface defines at least in part a downwardly facing water inlet opening through which water may be drawn and a curved discharged path that curves upwardly from said water inlet opening toward the bulkhead. A support plate is fixed to the rear side of the bulkhead. An extension housing is affixed to the support plate at one end thereof. A jet propulsion system is carried by the other end of the extension housing. The jet propulsion system is comprised of an outer housing having an impeller portion, an impeller rotatably journalled about an impeller axis in the impeller portion and driven by the prime mover and a discharge nozzle portion positioned rearwardly of the impeller though which the water pumped by the impeller is discharged for propelling the personal watercraft. The support plate and the extension housing defining a water opening path leading in a direction parallel to the impeller axis and having a shape that constitutes generally an extension of the opening of an inlet to the impeller housing portion so as to isolate the pulsations generated by the impeller. The water opening path has a length greater than the axial length of the impeller.

DETAILED DESCRIPTION

Figure 1:
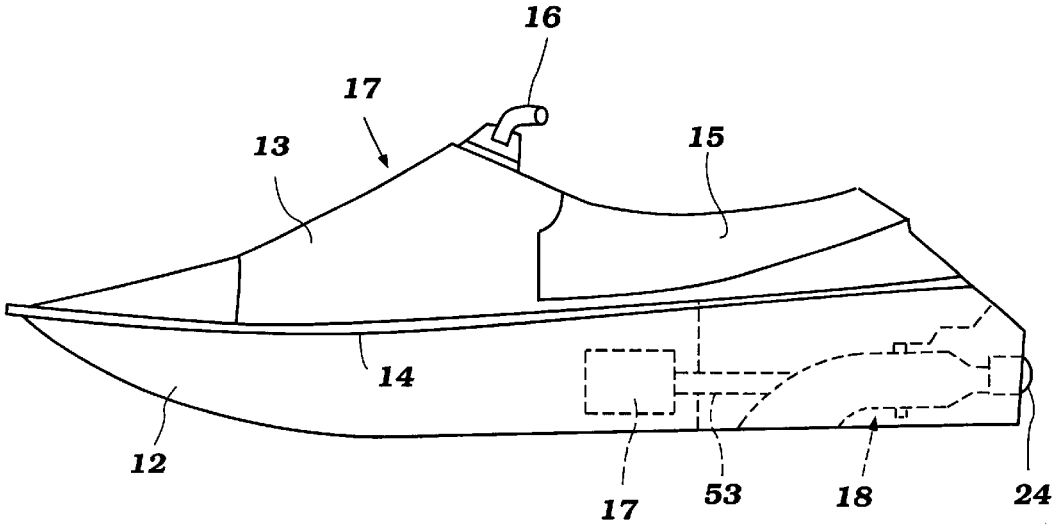
FIG. 1 is a side elevational view of a personal watercraft constructed in accordance with an embodiment of the invention.

Referring in detail first to FIG. 1, a personal watercraft constructed in accordance with an embodiment of the invention is shown and identified generally by the reference numeral 11. It is to be understood that, although the invention is described in conjunction with a personal watercraft, certain of the features herein disclosed may be utilized with other types of watercraft. However, the invention has particular utility in conjunction with personal watercraft due to their small size, compact nature and due to the increased demand for providing quieter operating watercraft of this type.

The watercraft 11 is comprised of a hull that consists primarily of a hull under portion 12 and deck portion 13 that are connected to each other along their peripheral edges by a gunnel 14. The deck portion 13 has longitudinally extending riders, area on which a straddle type seat 15 on which the rider/operator and two or three additional passengers may be seated. The seating is in straddle, tandem position and the operator and his passengers place their feet in foot wells disposed on opposites sides of the seat 15.

A control handlebar 16 is positioned forwardly of the seat 15 for operation by the rider/operator so as to steer the watercraft, control it speed and other functions.

A prime mover such as an internal combustion engine, shown schematically at 17 is contained in an engine compartment that is formed within the hull under portion 12 and which may be accessible through removal of the seat 15 and exposure of an access opening formed in the raised part of the riders' area of the deck portion 13. This engine 17 drives a jet propulsion unit, indicated generally by the reference numeral 18, positioned in a tunnel at the rear of the hull under portion 12 in a manner, which will be described now in connection with reference to FIGS. 1 through 5.

Figure 2:
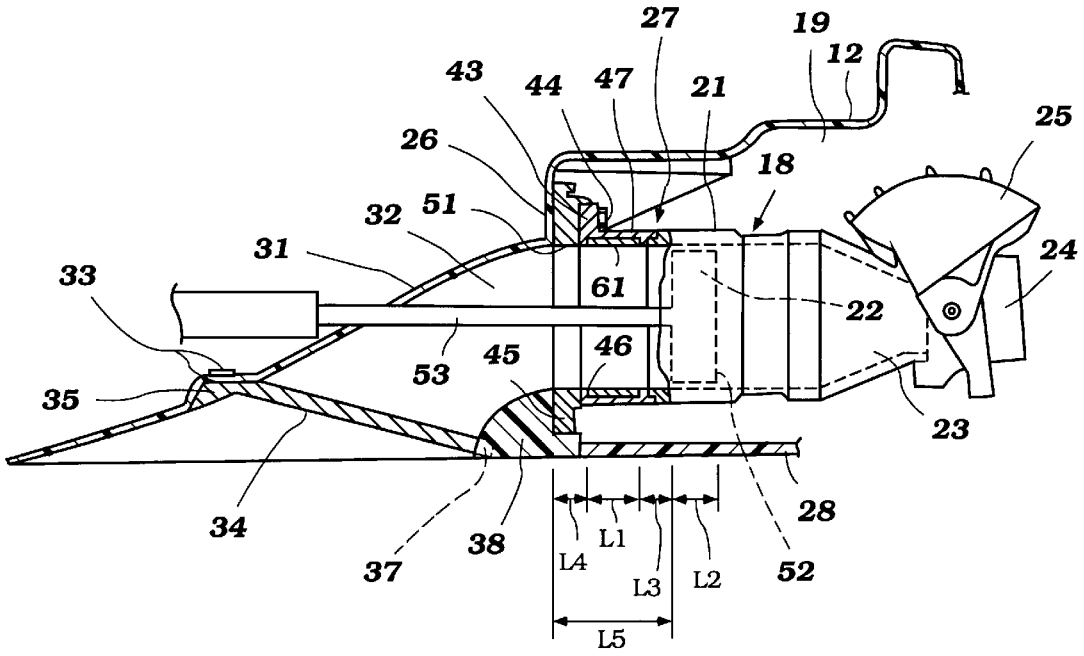
FIG. 2 is an enlarged broken away view showing the construction of the jet pump arrangement of embodiment shown in FIG. 1.

Referring now primarily to these figures, the hull under portion 12 has a portion that defines a tunnel 19 in which the conventional jet propulsion unit housing assembly is mounted. This conventional part of unit includes the impeller housing portion 21 that contains the impeller 22, a discharge nozzle portion 23, a steering nozzle 24 and a reverse thrust bucket 25. In FIG. 2, the reverse thrust bucket 25 is shown in its opened or forward drive condition.

In this embodiment, the impeller housing portion 21 is disposed rearwardly from a bulkhead 26 formed by the hull under portion 12 forwardly of the tunnel 19 and at the rear of the compartment containing the engine 17 so as to accommodate a silencing or extension and mounting assembly, indicated generally by the reference numeral 27. This silencing extension assembly 27 will be described in more detail later by reference to FIGS. 2–5. It is this silencing extension assembly 27 that is utilized, at least in part, to secure the jet propulsion unit impeller housing portion 21 and other attached components to the bulkhead 26.

Figure 5:
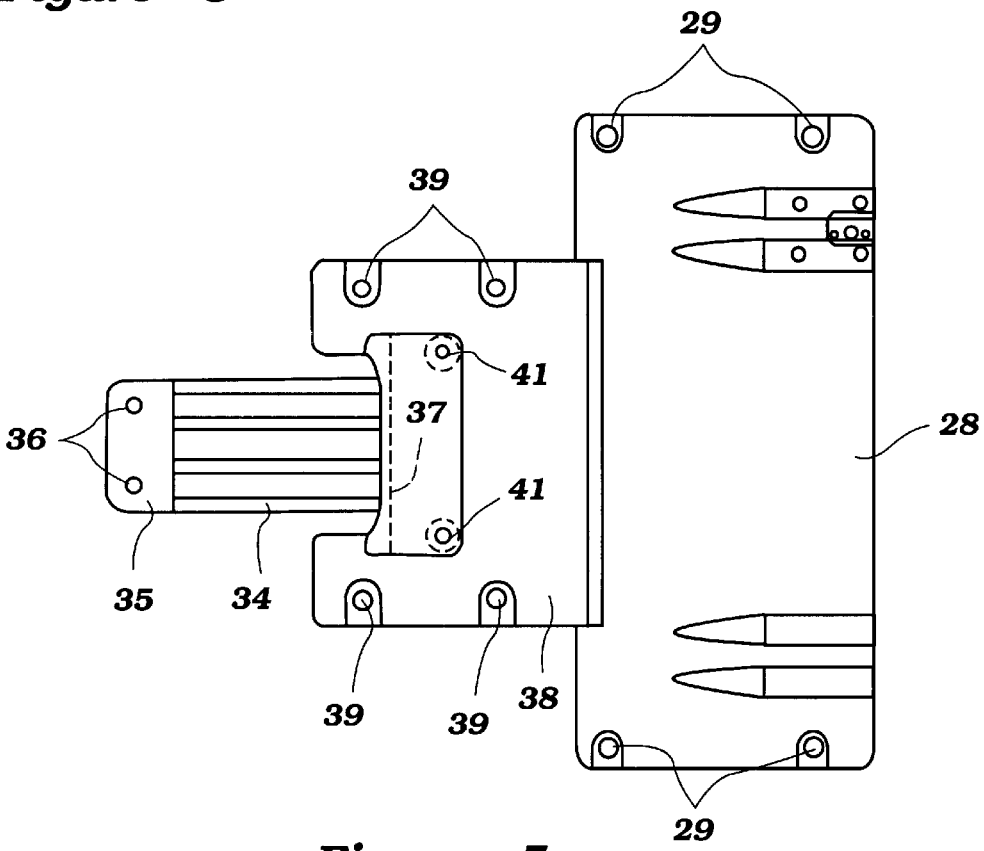
FIG. 5 is a bottom plan view of the components shown in FIG. 2 and which comprise generally the underlying units of the jet propulsion system.

In this assembly, a ride plate, indicated generally by the reference numeral 28 and as seen in FIG. 5, is comprised of flanges that receive threaded fasteners 29 for affixing it suitably to the hull under portion 12.

It will be seen from FIG. 2 that forwardly of the bulkhead 26 the hull under portion 12 has a generally curved configuration 31 that defines a water inlet passage 32 that curves upwardly and which registers with the silencing extension assembly 27 in manner to be described. However, the generally curved configuration 31 is formed with an indentation 33 which cooperates with a grill assembly 34 that has a plurality of spaced grilled bars and mounting portion 35 at its forward end. Threaded fasteners 36 connect this portion of the grill assembly 34 to a reinforcement plate formed on the inner surface of the hull generally curved configuration 31.

The rear end of the grill assembly 34 is received in a recess 37 of an additional mounting plate 38 that is affixed to the hull under portion 12 by threaded fasteners 39 and further fasteners 41 that are connected to an extension piece of the mounting plate 38 that defines the recess 37. It will be seen from FIG. 3 that this then provides a fairly wide and elongated inlet opening for the water inlet passage 32.

Figure 3:
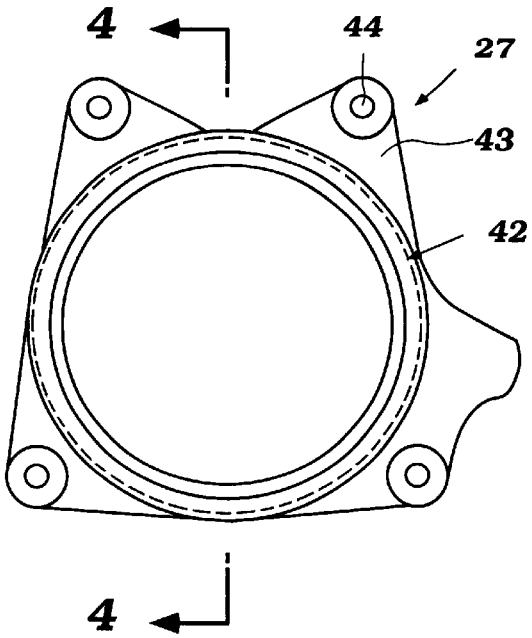
FIG. 3 is an enlarged front elevational view showing the front or inlet face of the support plate for the jet propulsion unit in accordance with this embodiment of the invention.
Figure 4:
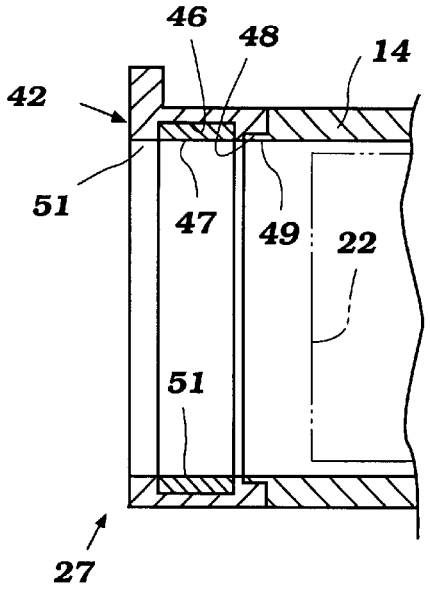
FIG. 4 is a cross sectional view taken along the line 4—4 of FIG. 3 and shows the attached components.

Referring now to the construction of the silencing extension assembly 27, by reference primarily to FIGS. 2–4, it includes a mounting flange portion, indicated generally by the reference numeral 42. This flange portion 42 has lugs 43 that receive threaded fasteners 44 for securing the mounting bracket to a further mounting plate 45 that is fixed in a recess defined by the bulkhead 26 and the mounting plate 38.

The mounting flange portion 42 further forms an annual groove 46 in which an elastic sleeve 47 is positioned. Rearwardly of this, the mounting flange portion 42 has a recess 48 that receives an extension 49 of the impeller housing 14 (FIG. 4). This construction provides a continuous water flow path through the silencing extension assembly 27 best seen in FIG. 2). That is, the silencing extension assembly 27 and the mounting plate 45 define a continuous opening 51 extending rearwardly of the bulkhead 26. This passageway is substantially the same diameter as that of the portion 52 of the impeller housing 14 that surrounds the impeller 22. This has a length L5 which is comprised of the segment L4 which comprises the length of the portion of the continuous opening 51 in the mounting plate 45, the length L1 which is the combined length of the mounting flange portion 42 and the elastic sleeve 47 and the length L3 which comprises the remainder of the length downstream of the elastic sleeve 47 and upstream of the impeller 22. The impeller length L2 is approximately equal to about 50 mm while the length L5 is about 80 mm. In other words, the length L5 is substantially greater than the length of the impeller 22 and in fact nearly double that length. This provides very, very effective silencing and isolation of pulsation damping in addition to the damping effect caused by the elastic sleeve 47.

As shown in FIGS. 1 and 2 an impeller shaft 53 that extends forwardly through the water inlet passage 32 for its coupling to the output shaft of the engine 17 through a surrounding protective sleeve (not shown).

Figure 6:
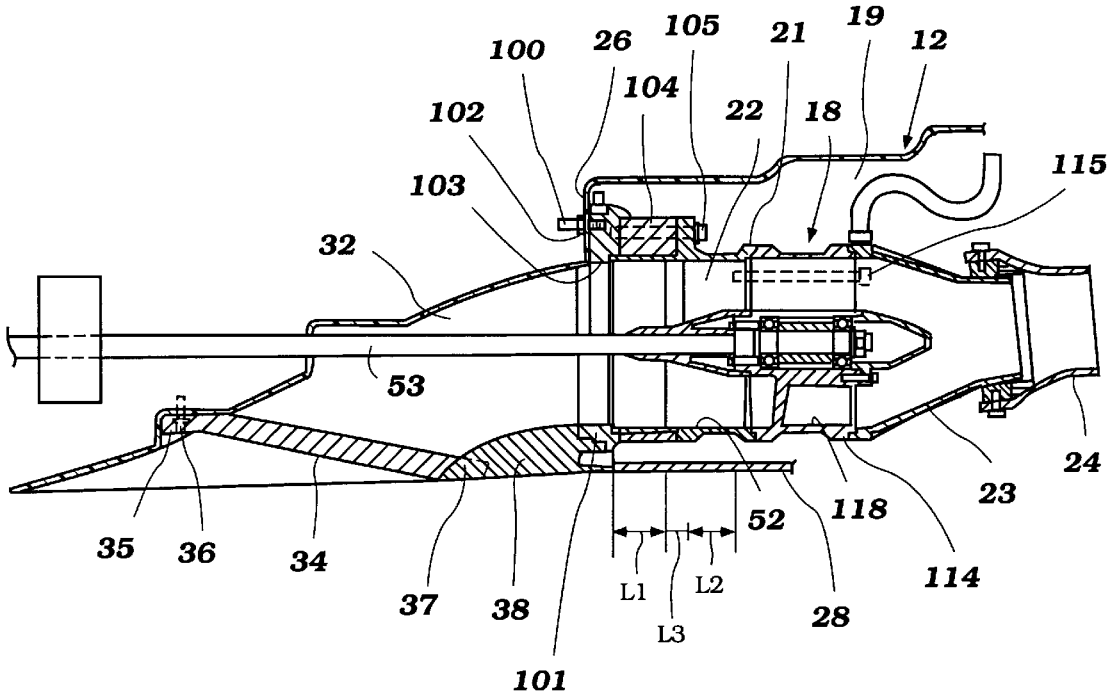
FIG. 6 is a cross sectional view in part similar to FIG. 2, but showing a further embodiment of the invention.
Figure 7:
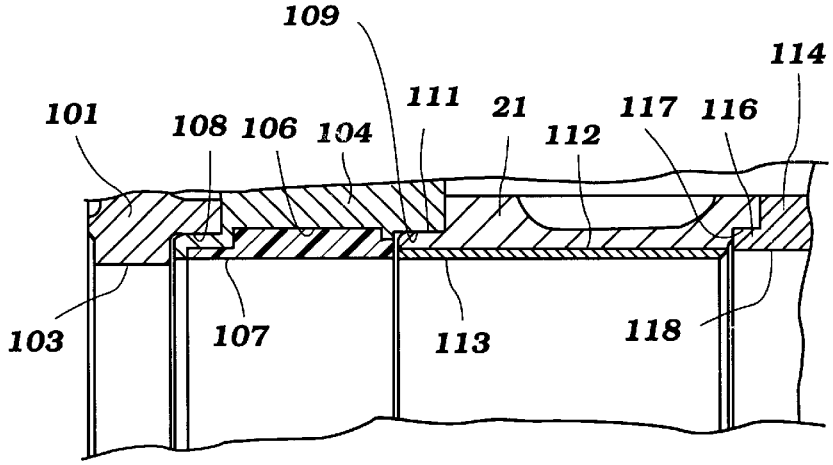
FIG. 7 is a further enlarged cross sectional view of a portion of the structure shown in FIG. 6.

FIGS. 6 and 7 show another embodiment of the invention, which is similar in many regards to the embodiment thus far described. Where the same components are employed, they have been identified by the same reference numerals and will not be described in more detail. This embodiment, however, permits greater latitude in adjustment of the length of the various components leading up to the impeller 22.

In this embodiment, a first mounting flange 101 is affixed to the bulkhead 26 by means of threaded fasteners comprised of studs 100 threaded into the mounting flange and nuts 102 received thereon. This mounting flange 101 has a water flow opening 103 that has substantially the same diameter as the remaining openings leading up to the impeller 22 and the inner diameter 52 of the impeller housing 21.

Affixed to this mounting flange 101 is a spacer flange 104 that is fixed to the mounting flange 101 by threaded fasteners 105. The spacer flange 104 has a stepped opening 106 in which an elastomeric sleeve 107 is received. It should be seen that this sleeve 107 actually extends forwardly within a recess 108 of the mounting flange 101 so that the elastic sleeve 107 can have a greater length than the previously described embodiment. In this embodiment the impeller housing 14 has an outer flange against which the threaded fasteners 105 act to secure the impeller housing 14 to the spacer flange 104 and thus to the mounting flange 101 and the bulkhead 26.

In addition, the rear portion of the spacer flange 104 is provided with a recess 109 that receives an extending portion 111 of the impeller housing 14. This extending portion 111 backs up the elastic sleeve 107 and holds it in place.

The impeller housing 14 is formed primarily from aluminum or an aluminum alloy. Therefore a suitable lining material 112 such as a stainless steel sleeve may be provided around the inner surface of the impeller housing portion 14. This provides corrosion protection and reduced cost. The lining sleeve 112 has an inner diameter 113 that is the same as the flow opening 103 and the elastic sleeve 107 and the diameter 52 of the impeller housing 21 Therefore, there is provided a flow length consisting of the dimensions L1 and L3 provided by the mounting sleeve 104 and a part of the impeller housing formed by the extension 111. This combined length is substantially greater than the length L2 of the impeller 22. In this particular embodiment, these lengths are equal to approximately 60 mm, which is greater than the length of the impeller, which is 55 mm (L8). Of course, the length of the intake passage 103 formed in the mounting rings 101 further adds to the silencing effect.

These drawings further show how a nacelle and straightening vane section 114 of the jet propulsion unit 18 is connected to the impeller housing 21 by threaded fasteners 115. A tongue 116 of the nacelle and straightening vane section 114 fits into a groove 117 in the rear of the impeller housing 21 for ease of assembly and alignment. A similar tongue and groove arrangement is provided in the connection at the rear of the nacelle and straightening vane section 114 to the discharge nozzle section 23. The nacelle and straightening vane section 114 has a flow diameter 118 that is the same as those upstream flow diameters.

Thus, from the foregoing description is should be readily apparent that the features of the invention provide a very effective silencing for the jet propulsion unit for powering a watercraft that is particularly adept for use in personal watercraft. It is to be understood, however, that the foregoing description is that of preferred embodiments of the invention and various changes and modifications may be made without departing from the spirit and scope of the invention, as defined by the appended claims.

What is claimed is:

1. A personal watercraft comprised of a hull having an undersurface including a vertically extending bulkhead defining in part a rear portion of an engine compartment containing a prime mover, said hull undersurface defining at least in part a downwardly facing water inlet opening through which water may be drawn and a curved discharged path that curves upwardly from said water inlet opening toward said bulkhead, a support plate fixed to the rear side of said bulkhead, an extension housing affixed to said support plate at one end thereof, a jet propulsion system carried by the other end of said extension housing, said jet propulsion system comprising an outer housing having an impeller portion, an impeller rotatably journalled about an impeller axis in said impeller portion and driven by said prime mover and a discharge nozzle portion positioned rearwardly of said impeller though which the water pumped by said impeller is discharged for propelling said personal watercraft, said support plate and said extension housing defining a water opening path leading in a direction parallel to said impeller axis and having a shape that constitutes generally an extension of the opening of an inlet to said impeller housing portion so as to isolate the pulsations generated by said impeller, said water opening path having a length substantially greater than the axial length of said impeller.

2. A personal watercraft as set forth in claim 1 wherein the water opening path includes an elastomeric sleeve for further damping water pulsations caused by said impeller.

3. A personal watercraft as set forth in claim 2 wherein the elastomeric sleeve is carried by the extension housing.

4. A personal watercraft as set forth in claim 3 wherein the inner diameter of the elastic sleeve is substantially the same as and forms a portion of the water opening path.

5. A personal watercraft as set forth in claim 1 wherein the jet propulsion unit outer housing is detachably connected to the extension housing.

6. A personal watercraft as set forth in claim 5 wherein the jet propulsion unit outer housing impeller portion is detachably connected to the extension housing.

7. A personal watercraft as set forth in claim 6 wherein the jet propulsion unit outer housing impeller portion has a length upstream of the impeller that forms a further part of the water opening path.

* * * * *